US008016579B2

(12) United States Patent
Sakakibara et al.

(10) Patent No.: US 8,016,579 B2
(45) Date of Patent: Sep. 13, 2011

(54) SUPERABRASIVE GRAIN SETTING APPARATUS

(75) Inventors: Sadao Sakakibara, Hekinan (JP); Kodo Kobayashi, Okazaki (JP); Hiroyasu Shimizu, Okazaki (JP); Kazuhiko Sugita, Anjo (JP)

(73) Assignee: Toyoda Van Moppes Ltd., Okazaki-shi (JP)

( * ) Notice: Subject to any disclaimer, the term of this patent is extended or adjusted under 35 U.S.C. 154(b) by 358 days.

(21) Appl. No.: 12/269,297

(22) Filed: Nov. 12, 2008

(65) Prior Publication Data

US 2009/0142435 A1 Jun. 4, 2009

(30) Foreign Application Priority Data

Dec. 3, 2007 (JP) ..... 2007-312895

(51) Int. Cl.
*A21C 3/00* (2006.01)

(52) U.S. Cl. ..... 425/130; 425/150; 425/166; 428/206; 264/162; 264/219; 264/400; 51/293; 51/297

(58) Field of Classification Search ..... 428/206; 264/162, 219, 400; 51/297
See application file for complete search history.

(56) References Cited

U.S. PATENT DOCUMENTS

| | | | | | |
|---|---|---|---|---|---|
| 2,092,083 | A * | 9/1937 | Ogle et al. | ..... | 451/82 |
| 3,404,556 | A * | 10/1968 | Kameras | ..... | 73/7 |
| 3,611,639 | A * | 10/1971 | Ashworth | ..... | 451/38 |
| 3,759,383 | A | 9/1973 | Inoue | | |
| 5,495,410 | A * | 2/1996 | Graf | ..... | 700/86 |
| 5,880,956 | A * | 3/1999 | Graf | ..... | 700/86 |
| 5,954,446 | A * | 9/1999 | Ireland | ..... | 403/11 |
| 6,110,031 | A * | 8/2000 | Preston et al. | ..... | 451/541 |
| 6,366,831 | B1 * | 4/2002 | Raab | ..... | 700/262 |
| 2003/0186636 | A1 | 10/2003 | Akyuz et al. | | |
| 2005/0132822 | A1 * | 6/2005 | Massaro | ..... | 73/863.32 |
| 2006/0010780 | A1 * | 1/2006 | Hall et al. | ..... | 51/293 |
| 2009/0148342 | A1 * | 6/2009 | Bromberg et al. | ..... | 422/37 |

FOREIGN PATENT DOCUMENTS

| | | |
|---|---|---|
| BE | 1 012 247 A4 | 8/2000 |
| JP | 56-163879 | 12/1981 |

OTHER PUBLICATIONS

U.S. Appl. No. 12/272,125, filed Nov. 17, 2008, Sakakibara et al.

* cited by examiner

*Primary Examiner* — Jerry A Lorengo
*Assistant Examiner* — Ross J Christie
(74) *Attorney, Agent, or Firm* — Oblon, Spivak, McClelland, Maier & Neustadt, L.L.P.

(57) ABSTRACT

A superabrasive grain setting apparatus for arranging superabrasive grains on a surface of a manufacturing mold used in manufacturing a grinding tool includes a grip and raising mechanism for gripping the mold in a horizontal state and for turning the mold to a vertical state. A six-axis control robot is composed of a base arm mechanism with three controlled axes and a wrist unit with three controlled axes attached to the base arm mechanism. A superabrasive grain supply device has a grain storage for storing the superabrasive grains and a grain separation mechanism for separating the superabrasive grains in the grain storage one by one to a suction position. A suction nozzle is detachably mounted on an endmost arm of the robot and provided with a bent nose portion for drawing a grain of superabrasive to a nozzle end thereof at the suction position.

8 Claims, 10 Drawing Sheets

SUPERABRASIVE GRAIN SETTING APPARATUS

INCORPORATION BY REFERENCE

This application is based on and claims priority under 35 U.S.C. 119 with respect to Japanese patent application No. 2007-312895 filed on Dec. 3, 2007, the entire content of which is incorporated herein by reference.

BACKGROUND OF THE INVENTION

1. Field of the Invention

The present invention relates to a superabrasive grain setting apparatus for mounting superabrasive grains on a manufacturing mold which is used in arranging superabrasive grains on a grinding surface of a grinding tool such as grinding wheel, truing tool, dressing tool or the like in the manufacturing process for such a grinding tool.

2. Discussion of the Related Art

In the manufacturing of a grinding tool such as grinding wheel, truing tool, dressing tool or the like, it is often the case that a grinding surface of the grinding tool are formed by the use of superabrasive grains such as diamond, CBN (Cubic Boron Nitride) or the like. In this case, the grinding tool should have superabrasive grains arranged uniformly so that the grinding surface is able to grind a workpiece without any local imbalance in grinding operation. To this end, in manufacturing grinding tools, there is utilized a so-called "grain transfer method", wherein superabrasive grains arranged on an internal surface of a female-type manufacturing mold are transferred onto an external grinding surface of a male-type grinding tool, while superabrasive grains arranged on an external surface of a male-type manufacturing mold are transferred onto an internal grinding surface of a female-type grinding tool. It has been a practice that an abrasive grain layer is formed on a mold surface of a manufacturing mold which is used to form the grinding surface of the grinding tool, by arranging superabrasive grains in the same pattern or arrangement as they should be planted in the grinding surface of the grinding tool. The setting of the superabrasive grains on the manufacturing mold is a work needing preciseness and heretofore, has been performed by hand craft of a skilled worker. Then, because the work is the routine repetition of precision job steps, and for higher efficiency and higher productivity, there has been conceived a superabrasive grain setting robot 100 shown in FIG. 21. In the superabrasive grain setting robot 100, a suction nozzle 102 is provided to be movable by a moving mechanism (not shown) in the horizontal direction as well as in the vertical direction, and a carbon mold CW being a manufacturing mold is supported by a grip mechanism (not shown) to be rotatable about the axis thereof and to be adjustably placed upward and downward at a desired inclination angle. In this prior art system, first of all, the carbon mold CW is inclined upward to place a mounting surface of the carbon mold CW horizontally, as shown in FIG. 22, then the suction nozzle 102 is horizontally advanced to place a grain D of superabrasive on the extreme end thereof right over the mounting surface, as shown in FIG. 23, and the suction nozzle 102 is lowered vertically to mount each grain D of superabrasive on the mounting surface, as shown in FIG. 24.

The carbon mold CW for a grinding tool may be small in the opening diameter of a hole formed in the carbon mold CW or may have as a mounting surface a steep inclination taper surface, a tiny rounded surface, a deep groove or recess or the like in dependence on a shape of the tool to be manufactured.

However, in the known superabrasive grain setting robot system, it is unable to simultaneously perform an inclination movement of the carbon mold CW and an advance movement of the suction nozzle 102, and it is also unable to perform a moving operation of the suction nozzle in an oblique downward direction. For this reason, as shown in FIG. 25 for example, when the carbon mold CW is inclined and then the suction nozzle 102 is advanced straight, interference with the mounting operation of the suction nozzle 102 takes place sometime wherein the suction nozzle 102 hits an end surface of the carbon mold CW or any other portion than the extreme end of the suction nozzle 102 comes into contact with a projecting part of the carbon mold CW. Therefore, the known setting robot system is unable to work for carbon molds CW complicated in the shape of a surface which should have superabrasive grains D arranged thereon, and sometime, cannot perform the setting work. This naturally results in the need for human's hand as separate job step in performing the setting on portions on a carbon mold which are impossible for the known setting robot system to do so.

SUMMARY OF THE INVENTION

It is therefore a primary object of the present invention to provide an improved superabrasive grain setting apparatus which is capable of performing a setting work for a manufacturing mold having surfaces complicated in shape.

Briefly, according to the present invention, there is provided a superabrasive grain setting apparatus for arranging superabrasive grains, used to form a grinding surface of a grinding tool, on a surface of a manufacturing mold which is used in manufacturing the grinding tool. The apparatus comprises a grip and raising mechanism for gripping the manufacturing mold placed in a horizontal state and for turning the manufacturing mold to an upright position so as to make the axis of the manufacturing mold extend horizontally; and a six-axis control robot composed of a base arm mechanism with three controlled axes and a wrist unit with three controlled axes attached to the base arm mechanism, wherein the three controlled axes of the wrist unit comprise a sixth axis for turning an endmost arm about its own axis, a fifth axis intersecting with the sixth axis for pivoting the endmost arm and the sixth axis about its own axis, and a fourth axis for turning the endmost arm, the sixth axis and the fifth axis about its own axis intersecting with the fifth axis, and wherein the three controlled axes of the base arm mechanism comprise a third axis intersecting with the fourth axis to extend horizontally, a second axis extending in parallel with the third axis, and a first axis including a swivel member pivotably supporting the second axis for turning the swivel member about its own axis extending vertically. The apparatus further comprises a superabrasive grain supply device provided with a grain storage for storing the superabrasive grains and a grain separation mechanism for separating the superabrasive grains stored in the grain storage one by one to a suction position; and a suction nozzle detachably mounted on the endmost arm of the six-axis control robot and provided with a nose portion bent to have a nozzle end which is eccentric from the fifth and sixth axes, for drawing a grain of superabrasive to the nozzle end at the suction position.

With this construction, the suction nozzle mounted on the endmost arm of the six-axis control robot draws to its nozzle end superabrasive grains which are supplied one by one by the superabrasive grain supply device. Then, each grain of superabrasive held by the suction nozzle is set on the manufacturing mold which is gripped and raised to the upright position by the grip and raising mechanism for easier setting, from one side of the manufacturing mold. In this setting work, it is required to push each grain of superabrasive on the mounting surface with the axis of the nose portion of the suction nozzle extending normal to a mounting surface of the manufacturing mold. In the prior art setting device, it is difficult to synchronously control an inclination movement of the manufacturing mold and movements of the suction nozzle in vertical and front-rear directions, and therefore, an interference in the setting work takes place upon contact of any other portion than the nozzle end of the suction nozzle with a projecting part of the manufacturing mold.

However, in the present invention, the setting work is performed as follows for example. First of all, there is determined a reference position to which the suction nozzle with a grain of superabrasive drawn thereto should be positioned before the front of the manufacturing mold. After the determination of the reference position, the six-axis control robot is controlled to draw a grain of superabrasive from the grain storage at the suction position and returned to the reference position. Then, the suction nozzle with the grain of superabrasive is linearly moved to a position very close to a mounting surface of the manufacturing mold in an oblique direction in either one of vertical and left-right directions (i.e., in a direction along an oblique side on an imaginary cone). This linear movement is done by controlling turns about some or all of the first to fifth axes. Then, the axis of the bent nose portion of the suction nozzle is directed to be normal to the mounting surface by controlling turns of one or more axes of the sixth axis, the fifth axis, the fourth axis and the like, and the grain of superabrasive on the suction nozzle is pushed on the mounting surface by moving the suction nozzle along the axis of the bent nose portion. This pushing movement is done also by controlling one or more axes of the first to fifth axes of the robot. After completing the mounting of the grain of superabrasive, the suction nozzle is moved to the superabrasive grain supply device, draws another grain of superabrasive to the nozzle end thereof and is moved to the reference position. Thereafter, in the same manner as described above, settings are performed on the mounting surface of the manufacturing mold over the entire circumferential surface through the angle of 360 degrees. In this way, each of the settings can be done through a simplified control operation involving a linear movement in an oblique direction.

Further, where the manufacturing mold takes a cylindrical shape having a hole whose opening diameter is small, the setting of each grain of superabrasive on the mounting surface can be done through another simplified control operation wherein the suction nozzle is entered the hole through a movement in parallel to the axis of the manufacturing mold and then, is moved along the axis of the nose portion thereof, without bringing any portion of the suction nozzle into contact with any projecting part of the manufacturing mold.

Further, since the nose portion of the suction nozzle is bent to be eccentric from the fifth axis and the sixth axis, the contact of the suction nozzle with the manufacturing mold can be obviated by striding over a projecting part of the manufacturing mold at the bent nose portion of the suction nozzle. Further, since the mounting work is performed with a base end portion of the suction nozzle attached to the endmost arm of the robot almost in parallel relation with the axis of the manufacturing mold, an interference which results from the contact of the suction nozzle with a projecting part of the manufacturing mold can be prevented from occurring in the setting work. In addition, by turning some or all of the sixth axis, the fifth axis, the fourth axis and the like, it can be done to mount superabrasive grains along the internal surface or the external surface of the manufacturing mold without turning the manufacturing mold about the axis of the same as is done in the prior art setting system. Therefore, the automatisation in the setting work can be enhanced.

BRIEF DESCRIPTION OF THE DRAWINGS

The foregoing and other objects and many of the attendant advantages of the present invention may readily be appreciated as the same becomes better understood by reference to the preferred embodiment of the present invention when considered in connection with the accompanying drawings, wherein like reference numerals designate the same or corresponding parts throughout several views, and in which.

DETAILED DESCRIPTION OF THE PREFERRED EMBODIMENT

Figure 1:
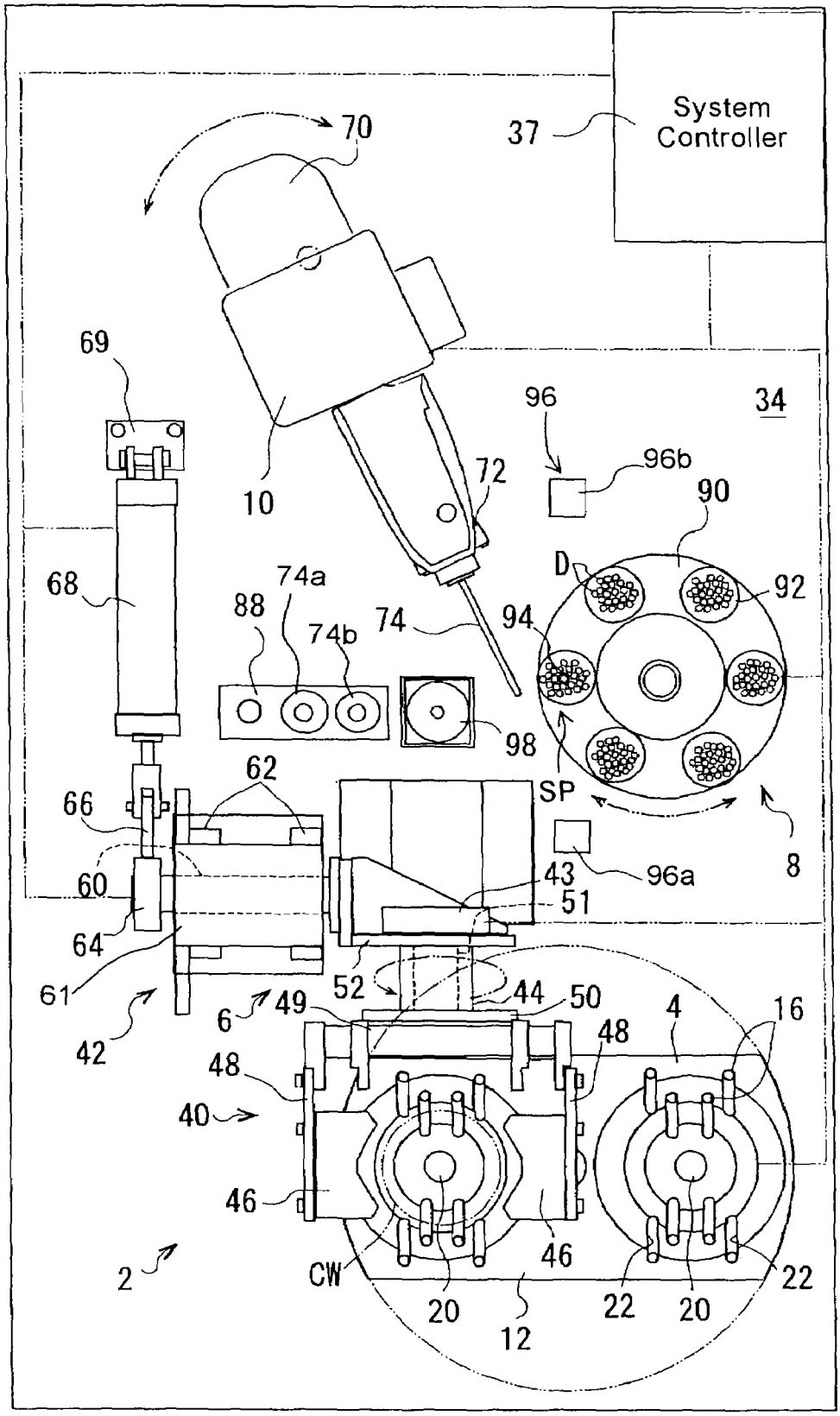
FIG. 1 is a plan view showing the schematic construction of a superabrasive grain setting apparatus in one embodiment according to the present invention.
Figure 2:
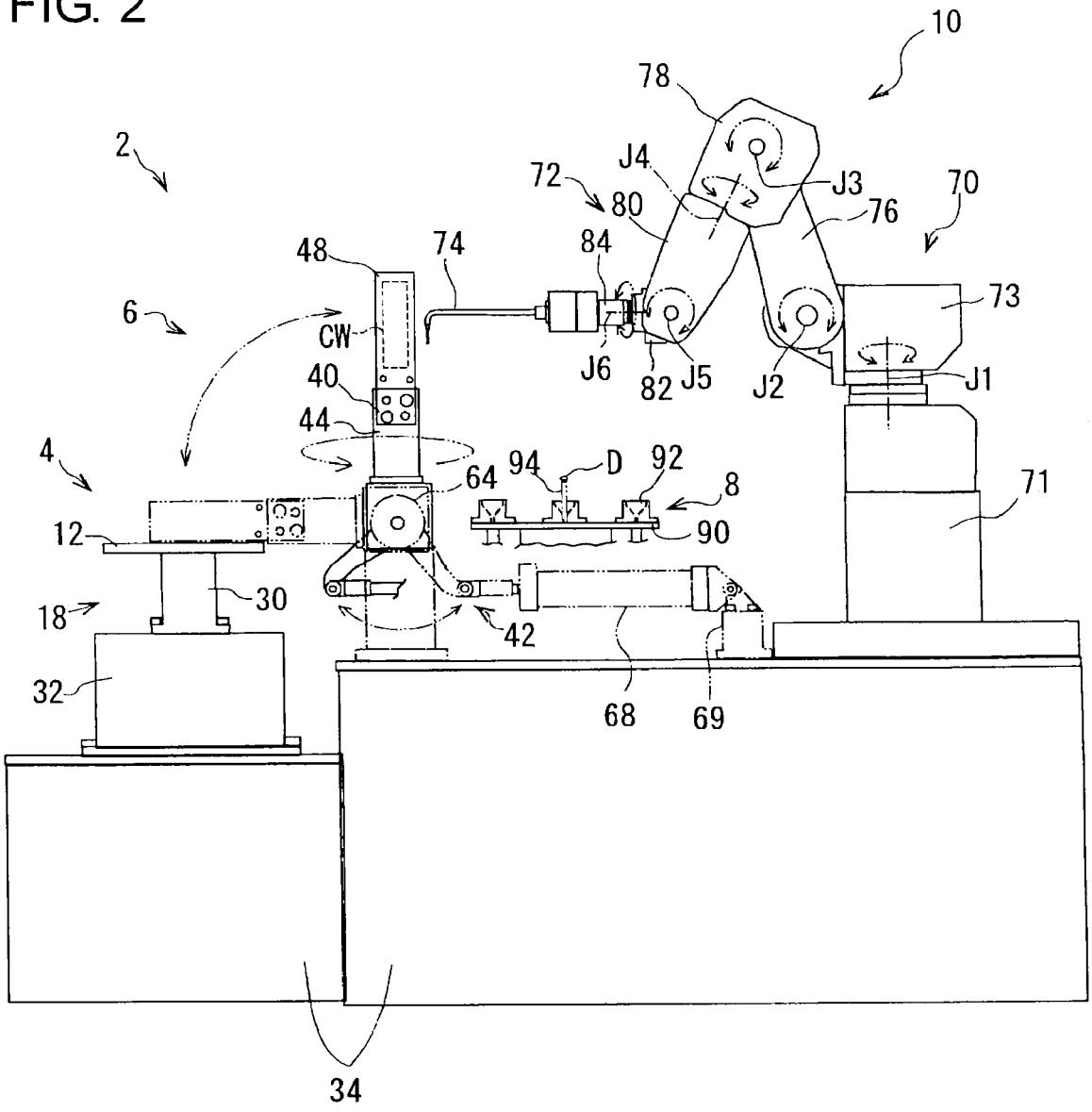
FIG. 2 is a side view of the superabrasive grain setting apparatus in the embodiment.

Hereafter, a superabrasive grain setting apparatus in one embodiment according to the present invention will be described with reference to the accompanying drawings. FIG. 1 is a plan view showing the schematic construction of the superabrasive grain setting apparatus, and FIG. 2 is a side view showing the schematic construction of the superabrasive grain setting apparatus. A manufacturing mold CW for use in manufacturing a grinding tool such as grinding wheel, truing tool, dressing tool or the like is made of, for example, carbon and takes a generally cylindrical form with flat end surfaces at opposite ends. In this illustrated embodiment, the settings of superabrasive grains are carried out on, for example, an internal surface of the manufacturing mold CW constituting a female-type mold.

The superabrasive grain setting apparatus indicated by reference numeral 2 is composed of a loading table device 4 for loading the manufacturing mold CW to a predetermined grip position, a grip and raising device 6 as a grip and raising mechanism for gripping and raising the loaded manufacturing mold CW, a superabrasive grain supply device 8 for storing diamond abrasive grains D as superabrasive grains which have been assorted in kind and for supplying the diamond abrasives D to be drawn one by one as described later, a six-axis control robot 10 for selectively drawing grains of diamond abrasives D and for mounting the same on the manufacturing mold CW one by one, and a system controller 37 for controlling the aforementioned various devices 4, 6, 8 and the robot 10 in accordance with predetermined program information.

Figure 3:
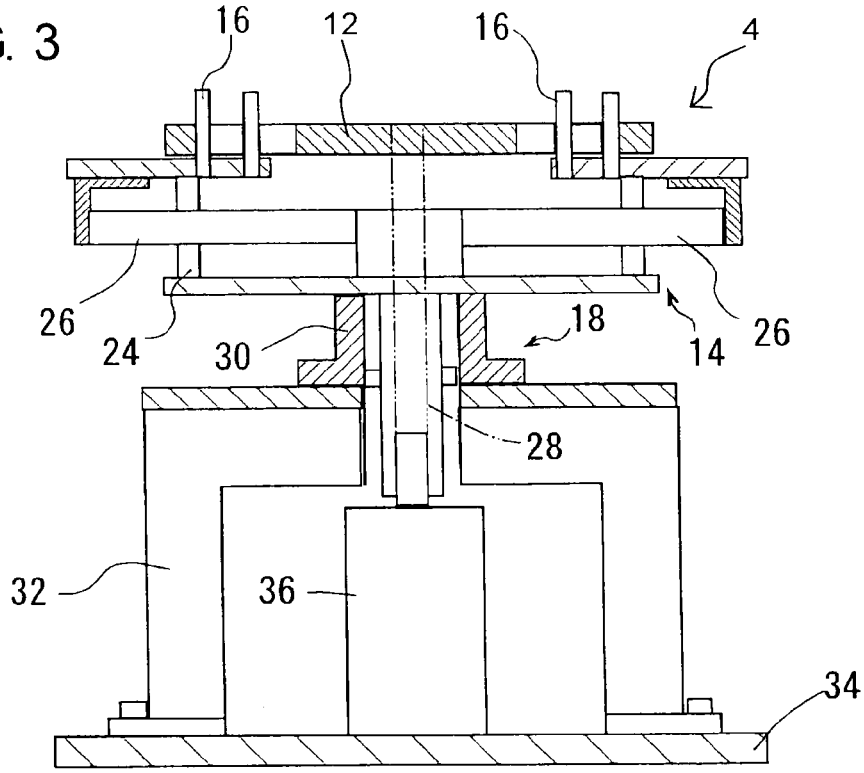
FIG. 3 is a sectional view of a loading table device incorporated in the superabrasive grain setting apparatus.

As shown in FIGS. 1 and 3, the loading table device 4 comprises an upper table 12 taking an elongate shape with arc-shaped opposite ends, a sliding mechanism 14 provided under the upper table 12, a plurality of sliding rods 16 slidden by the sliding mechanism 14 to grip the manufacturing mold CW, and a swivel mechanism 18 for turning the upper table 12 together with the sliding mechanism 14 in a horizontal direction. Loading and fixing portions 20 are formed at two places on the upper table 12, and each of the portions 20 is raised in a concentric, stepwise fashion, as viewed in FIG. 1. Four pairs of guide grooves 22 extending in the shorter-lengthwise direction of the upper table 12 are formed at each of the loading and fixing portions 20. The two Loading and fixing portions 20 are turnable through an angle of 180 degrees between a loading position (on the right side as viewed in FIG. 1) to which the manufacturing mold CW is loaded, and the grip position (on the left side as viewed in FIG. 1) which enables the grip and raising device 6 to grip the manufacturing mold CW. The sliding rods 16 extending upward are guided respectively along the guide grooves 22 and protrude from the guide grooves 22. Four pairs of the sliding rods 16 are slidden by the sliding mechanism 14 symmetrically with the center of each loading and fixing portion 20 to grip the manufacturing mold CW when they are moved to come close with each other. As shown in FIG. 3, the sliding mechanism 14 is housed in a case frame 24 which is fixed at its upper ends to the back surface of the upper table 12, and is provided with a pair of slide members 26 which are slidable by a grip drive motor (not shown) through a rack-and-pinion mechanism (not shown). The slide members 26 are secured at opposite end portions thereof to brackets protruding the sliding rods 16 upwards. The sliding rods 16 are slidden with the slide members 26 which are slidden symmetrically (i.e., toward an away from each other) by the operation of the grip drive motor.

As shown in FIG. 3, the swivel mechanism 18 is provided with a rotary shaft 28, which is protruded downward from the center of the upper table 12. The rotary shaft 28 is rotatably supported by a shaft frame 30 through antifriction bearings (not shown). The shaft frame 30 is secured at its base portion to a leg frame 32, which is secured to an apparatus base 34 by means of bolts or the like. A swivel drive motor 36 is housed in the leg frame 32 and is coupled to a lower end of the rotary shaft 28 through a reduction gear (not shown). The rotation of the swivel drive motor 36 is controllable by the system controller 37, and with the operation of the swivel drive motor 36, the upper table 12 is turnable through an angle of 180 degrees between the loading position and the grip position.

Figure 4:
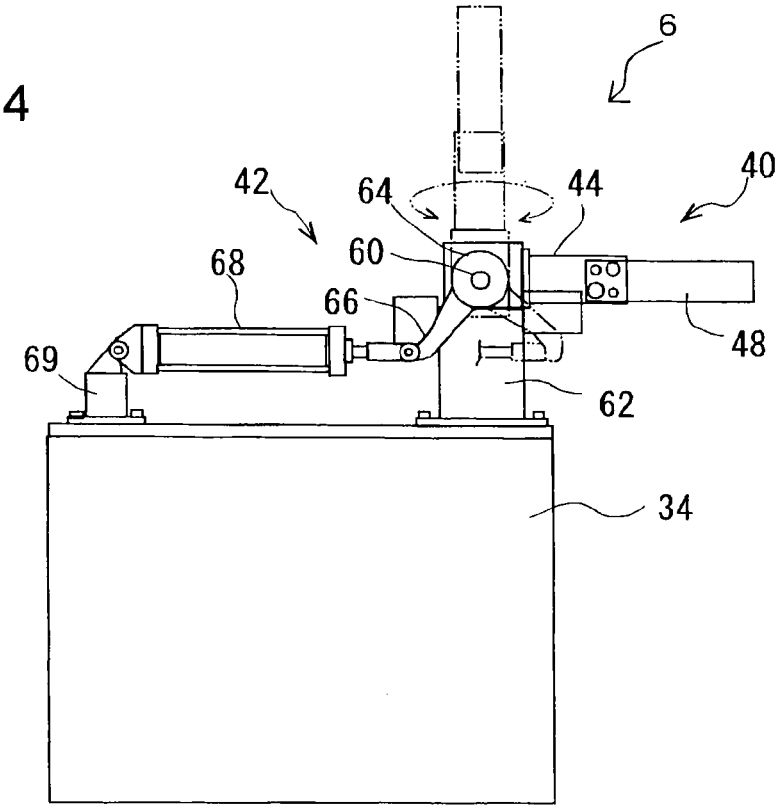
FIG. 4 is a side view of a grip and raising device incorporated in the superabrasive grain setting apparatus.

As shown in FIGS. 1 and 4, the grip and raising device 6 is composed of a grip mechanism 40 for gripping the manufacturing mold CW, a raising mechanism 42 for raising the grip mechanism 40 from a horizontal state to a raised or upright state, and a horizontal turning mechanism 44 as a rotary mechanism for turning the grip mechanism 40 in the upright state about a vertical axis.

The grip mechanism 40 is provided with a pair of chuck members 46 for embracing two diametrically opposite portions on the circumferential surface of the manufacturing mold CW. The chuck members 46 are secured and held by two support leg members 48, which are guided at their root portions to move toward and away from each other and are actuatable by a chucking air cylinder 49, so that the chuck members 46 can be opened and closed by the chucking air cylinder 49. The chucking air cylinder 49 is in communication with an air pump (not shown). The air supply from the air pump to the chucking air cylinder 49 is controlled by an electromagnetic valve (not shown) which is provided on an air communication line therebetween, and the electromagnetic valve is controllable by the system controller 37.

The chucking air cylinder 49 is secured to a support frame 50 which is mounted between the lower ends of the two support leg members 48. The support frame 50 protrudes a horizontally rotary shaft 51 from the other end portion opposite to one end portion mounting the chucking air cylinder 49. The horizontally rotary shaft 51 is supported by a rotary base frame 52 through antifriction bearings (not shown) to be rotatable about the axis thereof which extends in a vertical direction when the grip and raising device 6 is held at the raised position. The horizontally rotary shaft 51 is rotatable by a turning air cylinder 43 mounted on the rotary base frame 52. The horizontally rotary shaft 51, the turning air cylinder 43 and the like constitute a horizontally rotary mechanism 44. The turning air cylinder 43 is in communication with the air pump (not shown). The air supply from the air pump to the turning air cylinder 43 is controlled by another or second electromagnetic valve (not shown) which is provided on another air communication line therebetween, and the second electromagnetic valve is controllable by the system controller 37.

The rotary base frame 52 is secured to one end of a raising rotary shaft 60, which is supported through antifriction bearing 62 to be rotatable in a raising mechanism base 61 fixed on the apparatus base 34 and is rotatable about a horizontal axis orthogonal to the horizontally rotary shaft 51. The raising rotary shaft 60 has secured to the other end thereof a rotary disc 64 protruding a swing arm 66 from its circumferential surface. The extreme end of the swing arm 66 is linked to a piston of a raising air cylinder 68, whose base end portion is supported by a bracket 69 fixed on the apparatus base 34, and is pivotable in a vertical direction. The raising air cylinder 68 is in communication with the air pump (not shown), and another or third electromagnetic valve (not shown) is provided between the air pump and the raising air cylinder 68. The air supply from the air pump to the raising air cylinder 68 is controlled by the open/close operation of the third electromagnetic valve which is controllable by the system controller 37. With the operation of the raising air cylinder 68, the swing arm 66 is swung, so that the raising rotary shaft 60 is rotated in a range of 90 degrees to swing the grip mechanism 40 between the horizontal state and the upright or raised state. Thus, the superabrasive grain setting apparatus 2 is configured to perform the transfer of the manufacturing mold CW in the horizontal state that the manufacturing mold CW is held stably (i.e., with the axis of the manufacturing mold CW extending vertically), and to perform the setting work in the raised state that makes the setting work easier to do from one side of the manufacturing mold CW.

As shown in FIGS. 1 and 2, the six-axis control robot 10 is fixedly installed on the apparatus base 34 in front of the grip and raising device 6. The robot 10 takes the construction that a wrist unit 72 with three controlled axes is attached to a second arm 78 of a base arm mechanism 70 with three controlled axes and that a suction nozzle 74 (74*a*, 74*b*) is detachably attached to an endmost axis or arm of the wrist unit 72.

The base arm mechanism 70 is constructed as follows. That is, a swivel base 73 is mounted on a robot base 71 fixed on the apparatus base 34 and is tunable about a first axis J1 normal to a horizontal plane. Space-saving is sought by jointing the swivel base 73 with the robot base 71, fixed on the apparatus base 34, through the first axis J1 in this way. A first arm 76 is jointed with the swivel base 73 to be swingable vertically about a horizontal second axis J2. The aforementioned second arm 78 is jointed to an extreme end of the first arm 76 to be vertically swingable about a third axis J3 parallel to the second axis J2.

The wrist unit 72 is constructed as follows. That is, a third arm 80 is jointed with an extreme end of the second arm 78 of the base arm mechanism 70 to be turnable about a fourth axis J4 perpendicular to (i.e., crossing) the third axis J3. A fourth arm 82 is jointed with an extreme end of the third arm 80 to be pivotable about a fifth arm J5 perpendicular to (i.e., crossing) the fourth axis J4. A fifth arm 84 as the endmost arm is jointed with an end portion of the fourth arm 82 to be rotatable about a sixth axis J6 perpendicular to (i.e., crossing) the fifth axis J5. The suction nozzle 74 as an end effecter is removably attached to an end portion of the fifth arm 84. The suction nozzle 74 is in communication with a negative-pressure supply or vacuum pump (not shown) and draws a grain D of diamond abrasive to its nozzle end when having a negative pressure applied thereto. Three kinds of suction nozzles 74, 74*a*, 74*b* (refer to FIGS. 8 to 10) whose nozzle end or nose portions 74*n* are bent through angles of 90, 45 and 30 degrees are stored in a tool or nozzle magazine 88, as shown in FIG. 1. In this particular embodiment, the suction nozzle 74 shown in FIG. 8 has a right-angle nose portion 74*n* (hereafter referred to as "right-angle suction nozzle"), the suction nozzle 74*a* shown in FIG. 9 has a short gentle-angle nose portion 74*n* (hereafter referred to as "short-nose gentle-angle suction nozzle"), and the suction nozzle 74*b* shown in FIG. 10 has a long gentle-angle nose portion 74*n* (hereafter referred to as "long-nose gentle-angle suction nozzle").

For suction nozzle exchange, the six-axis control robot 10 is controlled to access the nozzle magazine 88 so that any used suction nozzle on the wrist unit 72 is returned to a vacant one of nozzle holders (not shown) in the nozzle magazine 88 and then, another suction nozzle is selectively attached to the wrist unit 72. Thus, each suction nozzle 74 (74*a*, 74*b*) on the wrist unit 72, together with the vacuum pump and still another or fourth electromagnetic valve (both not shown), constitute suction means for drawing a grain D of diamond superabrasive to the extreme end portion thereof.

Figure 11:
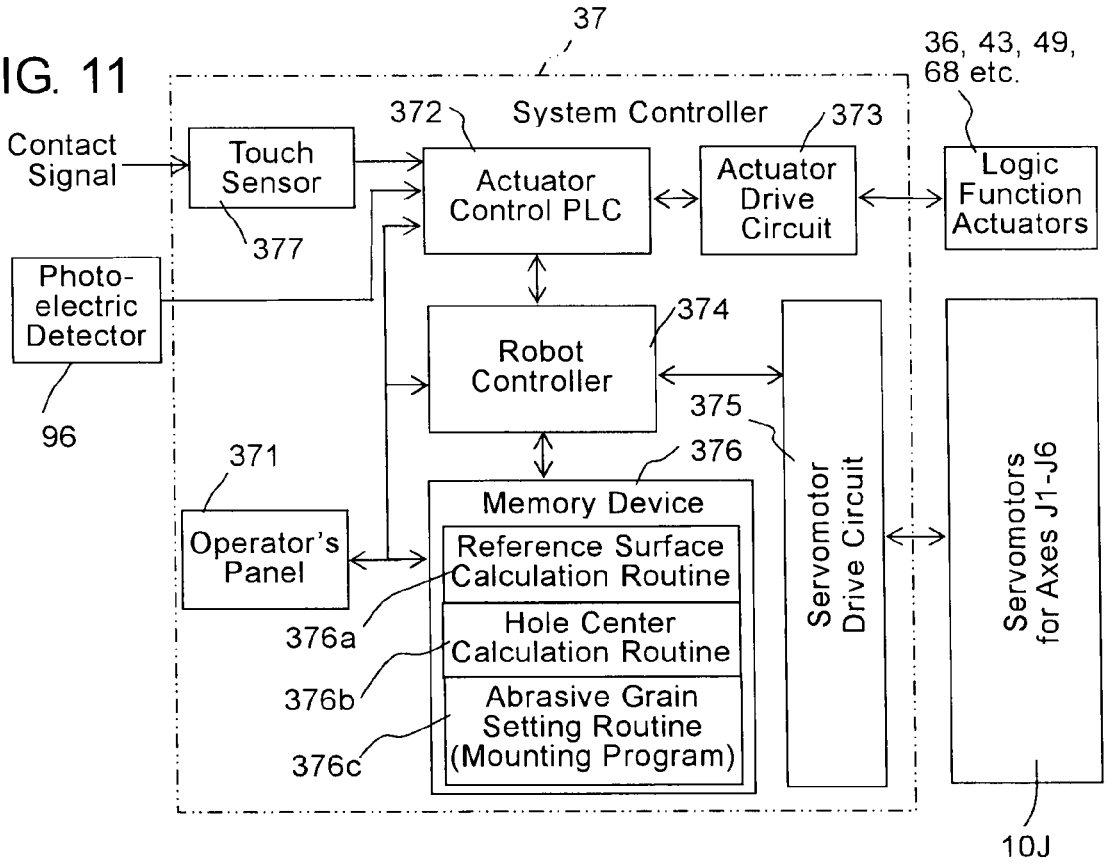
FIG. 11 is a schematic block diagram of a system controller for controlling the superabrasive grain setting apparatus.

Six actuators such as servomotors collectively designated by reference numeral 10J in FIG. 11 are provided for respectively driving the first to sixth control axes J1-J6 and are controllable by a robot controller 374 constituted by a microcomputer and the like incorporated in the system controller 37.

A weak current is applied to a chuck portion which is provided at an extreme end of the fifth or endmost arm 84 for selectively attaching the suction nozzles 74-74*b*. Thus, when the extreme end of the right-angle suction nozzle 74 which is assumed to have been attached to the wrist unit 72 for the purpose of explanation here is successively brought into plural places on a front end surface of the manufacturing mold CW which is held upright by the grip and raising mechanism 6, the robot controller 374 of the system controller 37 serves as reference surface calculation means for calculating coordinates of the respective contact points on the end surface of the manufacturing mold CW to obtain a reference surface for a setting work. Further, when each of the contact points are moved inward in the radial direction of the manufacturing mold CW, a contact end point in such a radial inward movement, that is, a position on a circle defining the opening of the internal surface of the manufacturing mold CW can be located, and by repeating this step for the plural places on the front end surface of the manufacturing mold CW, the robot controller 374 of the system controller 37 serves as hole center calculation means for calculating the coordinates of the center of the hole formed in the manufacturing mold CW. The information on the reference surface and the center of the hole is stored in the memory device 376 and is used to calibrate the coordinates of the six-axis control robot 70. Thus, the diamond abrasive grains D can be set precisely on programmed target positions on the internal surface of the manufacturing mold CW based on the shape of the manufacturing mold CW which has been inputted in a control program. In this way, each of the suction nozzles 74, 74*a*, 74*b* is used also as a touch sensing probe electrically connected to a touch sensor 377 incorporated in the system controller 37 as shown in FIG. 11, and therefore, is made of an elastic metal material.

Figure 12:
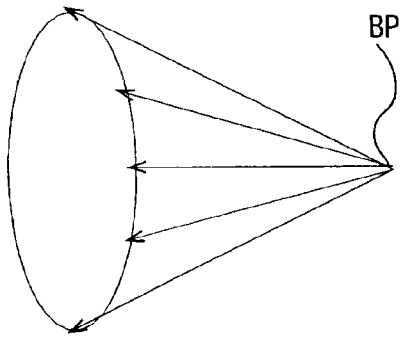
FIG. 12 is a chart showing the paths along which an extreme end of the suction nozzle moves in setting operations.

Further, based on the information, the robot controller 374 determines a virtual or imaginary cone as shown in FIG. 12 whose peak point BP is defined as a start point for setting operations toward those positions on the base circle of the cone along respective oblique sides, and those position on the base circle of the cone are set as positions close to the mounting target positions on a mounting surface of the manufacturing mold CW, as further described later in connection with the operation of the superabrasive grain setting apparatus 2. One of outstanding features of this particular embodiment resides in moving superabrasive grains D toward those positions on the base circle close to the mounting target positions along the respective oblique sides of the imaginary cone.

Figure 5:
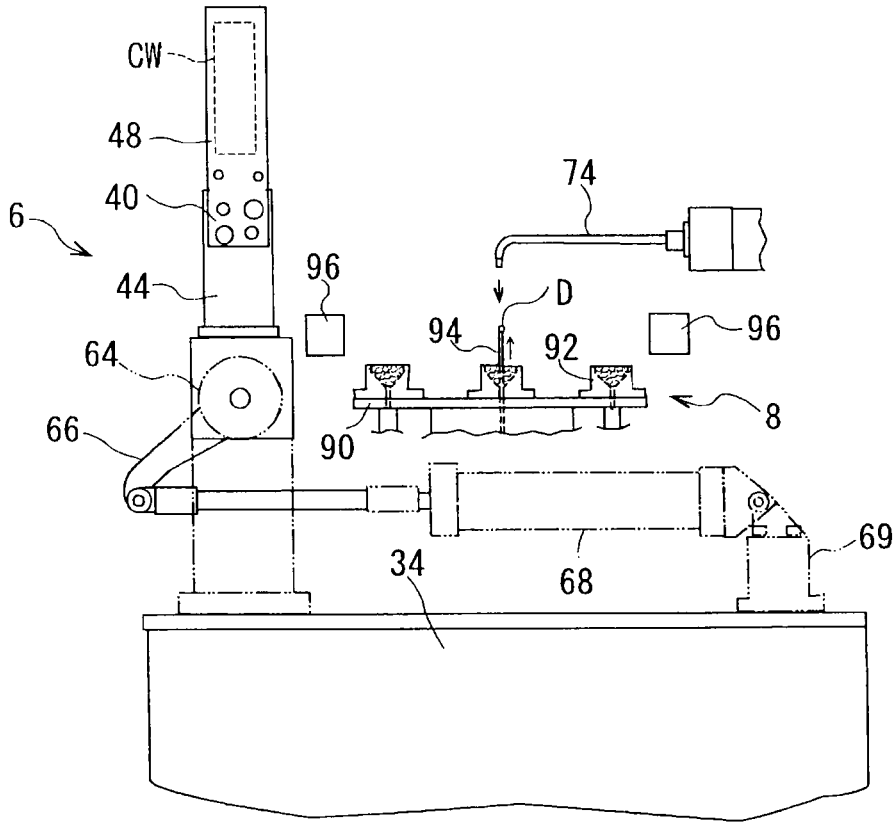
FIG. 5 is a side view showing a grain supply device and the operating state of a suction nozzle which are incorporated in the superabrasive grain setting apparatus.

Referring again to FIG. 1, the superabrasive grain supply device 8 is arranged at a position on one side which position is almost equidistant from both of the six-axis control robot 10 and the grip mechanism 40 held in the upright position. The supply device 8 includes a horizontal disc-like magazine or tray 90, on which a plurality (six in this particular embodiment) of funnel-shaped storage buckets or cases 92 as storages are arranged at equiangular intervals. The disc-like tray 90 is rotatable by an indexing drive motor (not shown) about a vertical rotary shaft (not shown) to selectively index the storage cases 92 to a supply position SP. As best shown in FIGS. 2 and 5, a lift-up rod 94 is provided in each of the storage cases 92 and is movable to vertically protrude from the bottom of a funnel portion of the storage case 92. When each of the storage cases 92 is selectively indexed to the supply position SP, the lift-up rod 94 of each such storage case 92 indexed to the supply position SP comes into alignment with a piston rod of a lift-up air cylinder (both not shown) which is arranged under the supply position SP, so that one grain D is lifted up and separated from other numerous diamond abrasive grains D contained in the storage case 92. Although not shown, each lift-up rod 94 is spring-biased to be usually retracted to a down position and has a small concavity on the top end for holding a single grain D of superabrasive thereon. Thus, a separation mechanism is constituted by the lift-up rods 94 and the lift-up air cylinder. A photoelectric detector 96 which is composed of a photo emitter 96*a* and a photo sensor 96*b* is arranged across the lift-up rod 94 moved upward at the supply position SP, so that the photoelectric detector 96 can detect the presence/absence and the quality (i.e., the propriety for use) of the single grain D of diamond abrasive which is held at a suction position on the top of the lift-up rod 94, as shown in FIGS. 1 and 5.

Referring to FIG. 11, the system controller 37 is shown comprising an operator's panel 371, an actuator control PLC (programmable logic controller) 372, an actuator drive circuit 373, the aforementioned robot controller 374, a servomotor drive circuit 375, a memory device 376, and the aforementioned touch sensor 377. The operator's panel 371 is used for inputting various control commands, data and programs, and the actuator control PLC 372 having the touch sensor 377, the photoelectric detector 96 and the operator's panel 371 connected thereto controls the operations of various logic function actuators such as the aforementioned various actuators and drive motors (except for the robot servomotors) through the actuator drive circuit 373 in accordance with a predetermined sequence control program (not shown) stored in advance. The robot controller 374 is operable in accordance with a reference surface calculation routine 376*a*, a hole center calculation routine 376*b* and an abrasive grain setting routine 376*c* which are stored in the memory device 376 in advance, and controls the servomotors 10J for the first to sixth axes J1-J6 of the six-axis control robot 10 through the servomotor drive circuit 375, as described later in detail. The touch sensor 377 is operable upon contact with the extreme end of each suction nozzle 74, 74*a*, 74*b* with the manufacturing mold CW during execution of each of the reference surface calculation routine 376*a* and the hole center calculation routine 376*b* and inputs a contact signal to the actuator control PLC 372. The aforementioned photoelectric detector 96 is also connected to the actuator control PLC 372 to input the presence/absence and the quality information of each grain G of superabrasive positioned on the suction position. The actuator control PLC 372 and the robot controller 374 are interactively connected for bidirectional data communication, so that the robot 10 and the aforementioned various actuators and drive motors can be controlled in a predetermined sequence which has been programmed to perform the superabrasive setting work, as described hereafter in detail.

(Operation)

Hereafter, description will be made regarding the operation of the superabrasive grain setting apparatus 2 as constructed above. First of all, a manufacturing mold CW is loaded on the loading and fixing portion 20 at the loading position (on the right as viewed in FIG. 1) of the loading table device 4. At this time, the manufacturing mold CW is placed in the horizontal state that it is stable. On the loading and fixing portion 20, by driving the rod drive motor (not shown) for the sliding mechanism 14, two pairs of the sliding rods 16 are slidden along the respective guide grooves 22, so that the manufacturing mold CW is held by the two pairs of sliding rods 16. Then, the swivel drive motor 36 is operated to turn the upper table 12 through an angle of 180 degrees. Thus, the manufacturing mold CW is moved from the loading position to the grip position and is released from the gripping by the two pairs of sliding rods 16 at the grip position. Subsequently, the grip mechanism 40 held at the upright position in advance is laid down by the operation of the raising air cylinder 68 to the horizontal state, in which state the both chuck members 46 of the grip mechanism 40 are placed at opposite sides of the manufacturing mold CW. The both chuck members 46 are closed by the operation of the chucking air cylinder 49, and the manufacturing mold CW is gripped at diametrically opposite portions on the circumferential surface thereof. Then, with the manufacturing mold CW gripped, the raising air cylinder 68 of the raising mechanism 42 is operated to pushingly swing the swing arm 66, so that the raising rotary shaft 60 is turned through an angle of 90 degrees to raise the grip mechanism 40 with the manufacturing mold CW gripped thereby to the raised or upright position. Thus, in this upright state, the setting work from one side of the manufacturing mold CW becomes easy, and this advantageously also results in space-saving in arranging the various devices in the setting apparatus 2. The aforementioned operations of the loading table device 4 and the grip and raising mechanism 6 are controlled by the actuator control PLC 372 in accordance with a predetermined sequence control program.

Thereafter, the six-axis control robot 10 is started to operate, an ID number of the manufacturing mold CW is checked, and a mounting program for mounting diamond abrasive grains D is selected for the identified manufacturing mold CW. The robot controller 374 of the system controller 37 controls the six-axis control robot 10 in accordance with an abrasive grain setting routine 376*c* which is executed by reference to, or in combination with, the selected mounting program, whereby the six-axis control robot 10 performs a setting work as instructed by arrangement date included in the selected mounting program, as follows:

First of all, the six-axis control robot 10 moves to the suction nozzle magazine 88 and selectively attaches one of the suction nozzles 74, 74*a*, 74*b* which is suitable for the setting work, to the extreme end of the fifth arm 84. At this time, selection is made from those shown in FIGS. 8 to 10 for one which is capable of positioning the axis of the nose portion 74*n* thereof to be normal to a mounting surface of the mold internal surface on which the diamond abrasive grains D are to be mounted and which is capable of coping with the depth of a groove or the like on the mounting surface of the manufacturing mold CW. For the purpose of explanation at this passage, it is assumed that the right-angle suction nozzle 74 is attached to the wrist unit 72 of the robot 10. Then, the robot controller 374 is operated in accordance with the reference surface calculation routine 376*a* stored in the memory device 376. As a consequence, the six-axis control robot 10 is moved to come close to the manufacturing mold CW held gripped by the grip and raising device 6 and brings the extreme end of the right-angle suction nozzle 74 into contact with a facing end surface of the manufacturing mold CW. This contact causes a weak electric current to flow through the manufacturing mold CW, so that such contact is detected by the touch sensor 377 responsive to a contact signal. Contact position data obtained at the time of such contact is collected as a piece of point group data for the manufacturing mold CW and is stored in the memory device 376 of the system controller 37. Such contact operation is carried out at each of plural points on the facing end surface of the manufacturing mold CW, and the robot controller 374 calculates a reference surface for a setting work from point group data so gathered. Thus, the robot controller 374 executing the reference surface calculation routine 376*a* serves as reference surface calculation means at this step and calculates three-dimensional coordinates of the reference surface.

Subsequently, the robot controller 374 is operated to executes the hole center calculation routine 376*b* stored in the memory device 376. Thus, the right-angle suction nozzle 74 which is held in contact with the facing end surface of the manufacturing mold CW is moved toward the center of the manufacturing mold CW, and a position where the contact is released upon reaching the hole of the manufacturing mold CW is found to be stored in the memory device 376 as a part of the three-dimension point group data for the manufacturing mold CW. This job step is performed at each of plural points on the facing end surface of the manufacturing mold CW, whereby a center of the hole of the manufacturing mold CW is calculated as three-dimension coordinates by the robot controller 374, which under the hole center calculation routine 376*b* serves as hole center calculation means at this step. Thus, the information so calculated and stored is used to calibrate the three-dimensional coordinates of the robot 10. As a consequence, the three-dimensional coordinates of a program start origin from which the six-axis control robot 10 should start the abrasive grain mounting program are calibrated by the coordinates of the calculated reference surface and the coordinates of the calculated hole center. Therefore, the robot controller 37 becomes ready to serve as mounting control means and controls the six-axis control robot 10 to start the setting work for diamond abrasive grains D in cooperation with the actuator control PLC 372 as follows.

That is, the superabrasive grain supply device 8 is controlled by the actuator control PLC 372 in the following sequence order. First, the storage case 92 containing the diamond abrasive grains D to be mounted is indexed to the supply position SP, and a grain D of diamond abrasive is separated from other diamond abrasive grains D by the lift-up rod 94 which is being pushed up by the lift-up air cylinder (not shown), to be protruded to the suction position, as shown in FIG. 5. At this time, judgments are made by the photoelectrical detector 96 for the presence/absence and the quality (i.e., the propriety for use) of the grain D of diamond abrasive which is protruded to the suction position. If no grain of diamond abrasive is present or the quality is not suitable for use, the step of protruding another grain of diamond abrasive is performed again.

In the abrasive grain setting routine 376*c*, the robot controller 374 then controls the six-axis control robot 10 to move the right-angle suction nozzle 74 to the suction position and draws the grain D of diamond abrasive on its extreme end. Whether the grain D of diamond abrasive is on the right-angle suction nozzle 74 or not is judged by checking the difference between pressures which are detected by a pressure sensor (not shown) before and after the suction movement of the six-axis control robot 10. If the suction is not done correctly, the grain D of diamond abrasive on the right-angle suction nozzle 74 is thrown away into an NG (no-good) box 98 shown in FIG. 1, and the suction step is carried out again. Needless to say, the pressure sensor is provided on an air path line which connects the vacuum pump (not shown) to the right-angle suction nozzle 74 on the wrist unit 72 of the robot 10.

Figure 6:
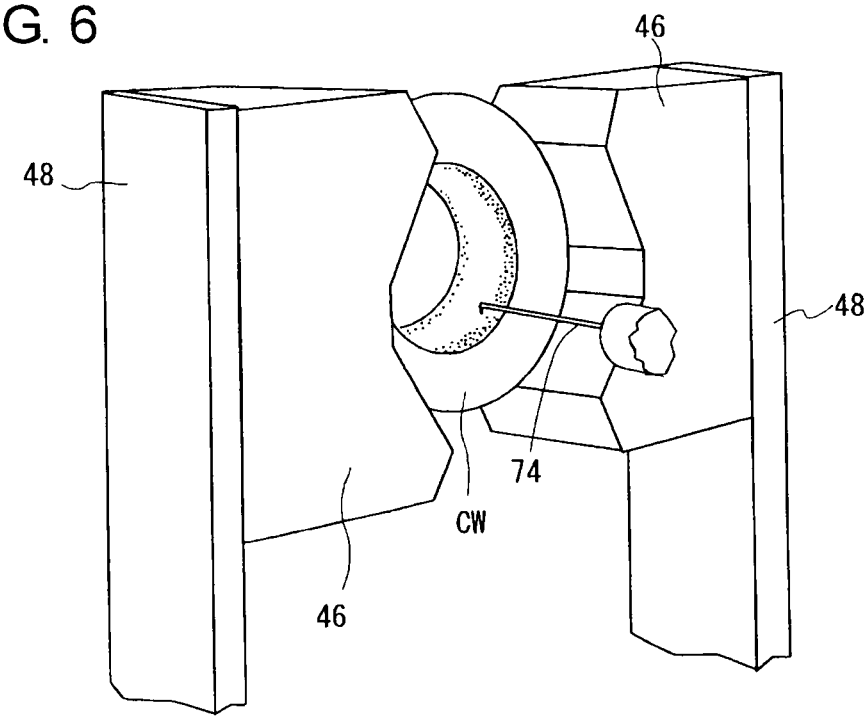
FIG. 6 is a perspective view showing a setting state on a manufacturing mold in the superabrasive grain setting apparatus.
Figure 7:
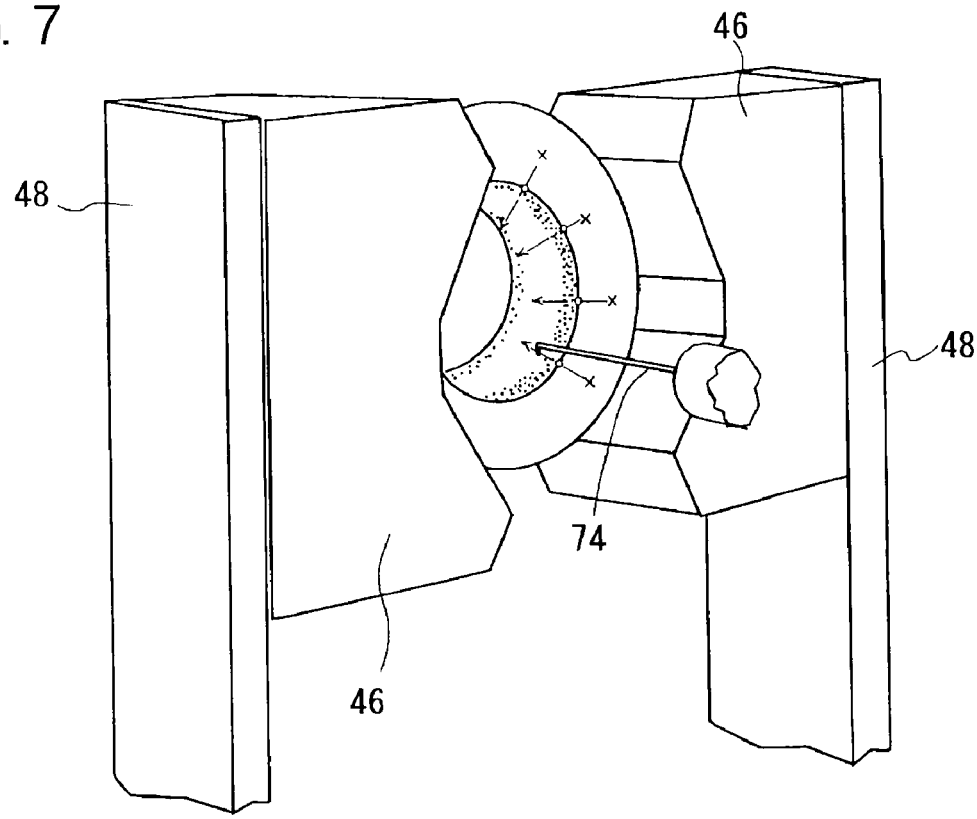
FIG. 7 is a perspective view showing the manner of determining a reference surface and a hole center of the manufacturing mold in the superabrasive grain setting apparatus.

Next, the diamond abrasive grain D drawn on the right-angle suction nozzle 74 is transferred by the six-axis control robot 10 to a mounting start or reference position BP (refer to FIG. 12) which is before the manufacturing mold CW gripped by the grip and raising device 6, as shown in FIG. 6. As mentioned earlier, the reference position BP is on the peak of the virtual or imaginary cone shown in FIG. 12. The imaginary cone can be obtained by calculation based on the previously calculated and stored information regarding the reference surface and the center of the hole of the manufacturing mold CW as well as on the mounting target positions which are designated by the mounting program on a mounting surface of the manufacturing mold CW. There, the imaginary cone is determined to define the peak point BP as a start point for setting operations toward those positions on the base circle of the cone along respective oblique sides, and those position on the base circle of the cone are set as positions close to the mounting target positions on the mounting surface of the manufacturing mold CW. Thus, the diamond abrasive grains D are mounted on the internal surface of the manufacturing mold CW as designated by the arrangement data of the mounting program.

Figure 13:
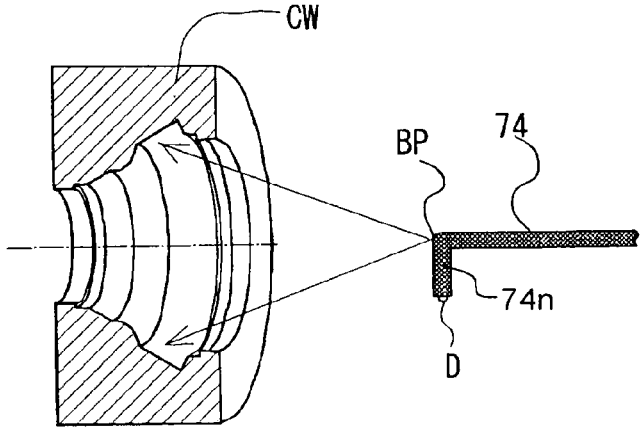
FIG. 13 is an explanatory view for showing one state in a setting operation using the right-angle suction nozzle.
Figure 14:
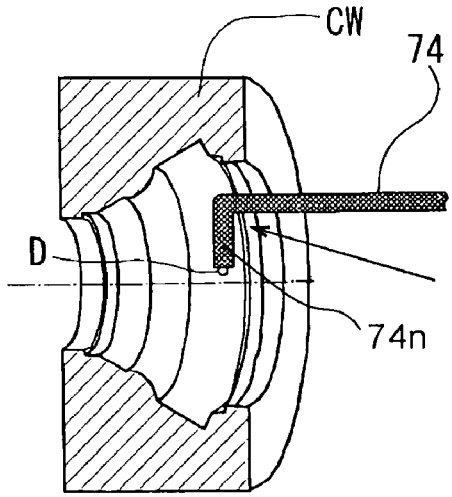
FIG. 14 is an explanatory view for showing another state in the setting operation using the right-angle suction nozzle.
Figure 15:
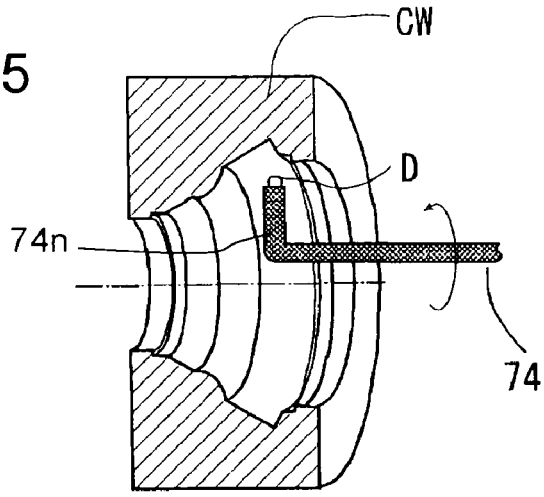
FIG. 15 is an explanatory view for showing still another state in the setting operation using the right-angle suction nozzle.
Figure 16:
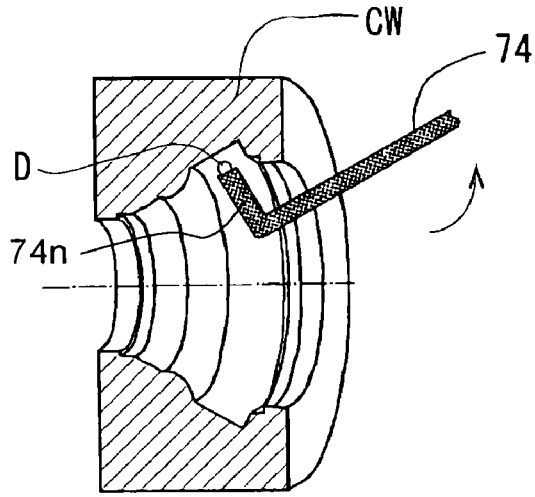
FIG. 16 is an explanatory view for showing a further state in the setting operation using the right-angle suction nozzle.

For example, the right-angle suction nozzle 74 with a grain D of diamond abrasive drawn thereon is linearly moved from the peak point BP as amounting reference position to a position on the base circle of the cone which position is spaced by a predetermine short distance from the mounting surface, as shown in FIGS. 13 and 14. At this time, the right-angle suction nozzle 74 is linearly moved forward in an oblique direction along an oblique side of the imaginary cone by mainly controlling rotations of, e.g., some or all of the first to the fifth axis J1-J5. Then, the nose portion 74*n* of the right-angle suction nozzle 74 is set to make the axis thereof normal to the mounting surface by turning some or all of the sixth to fourth axes J6-J4 and the like as shown FIGS. 15 and 16, and the grain D of diamond abrasive drawn on the extreme end of the right-angle suction nozzle 74 is set on the mounting surface by being brought into close to the mounting surface and then, by being pressed thereon. Since an adhesive has been applied to the mounting surface of the manufacturing mold CW in advance, the diamond abrasive grain D having been set on the mounting surface is held and adhered thereto by the adhesive.

Figure 18:
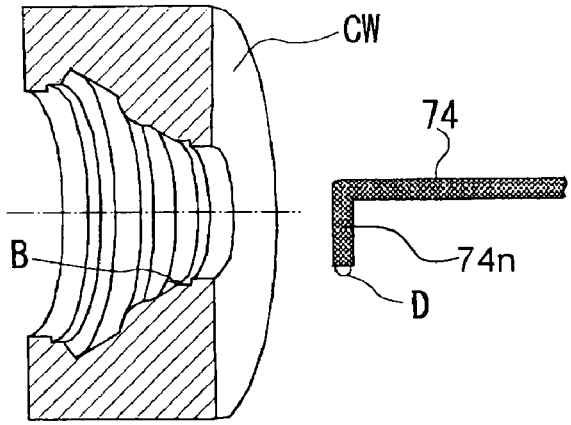
FIG. 18 is an explanatory view for showing another different state in a setting operation from the side of a small-diameter opening using the right-angle suction nozzle.
Figure 19:
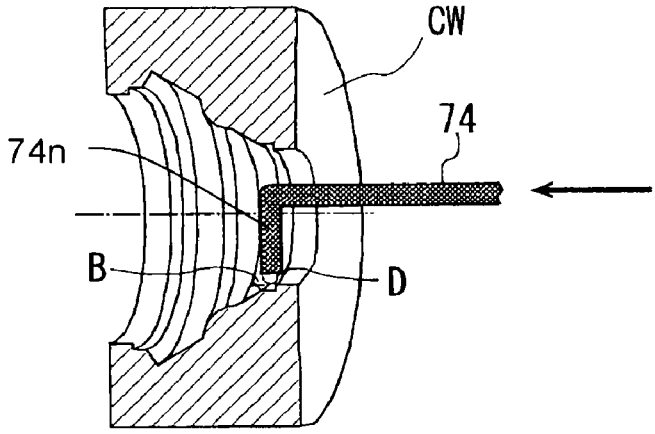
FIG. 19 is an explanatory view for showing another different state in the setting operation from the side of the small-diameter opening using the right-angle suction nozzle.
Figure 20:
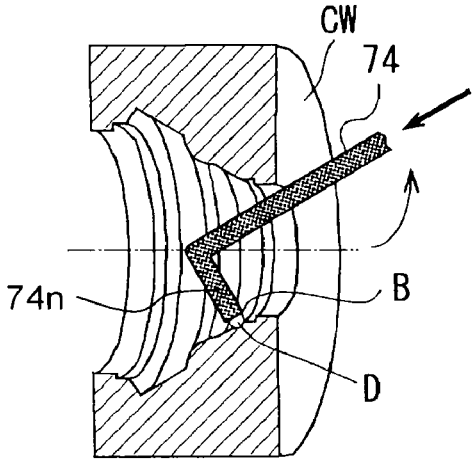
FIG. 20 is an explanatory view for showing a further different state in the setting operation from the side of the small-diameter opening using the right-angle suction nozzle.
Figure 21:
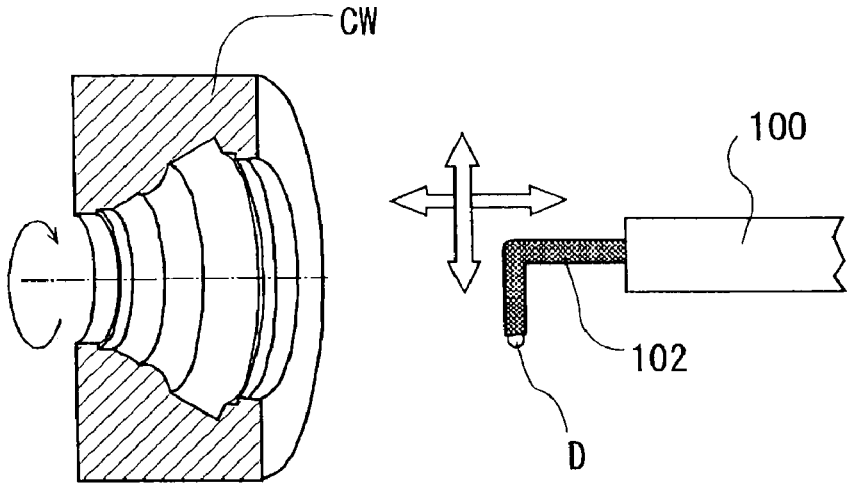
FIG. 21 Prior Art
FIG. 21 is an explanatory view for showing one state in a setting operation using the right-angle suction nozzle in the prior art setting apparatus.
Figure 22:
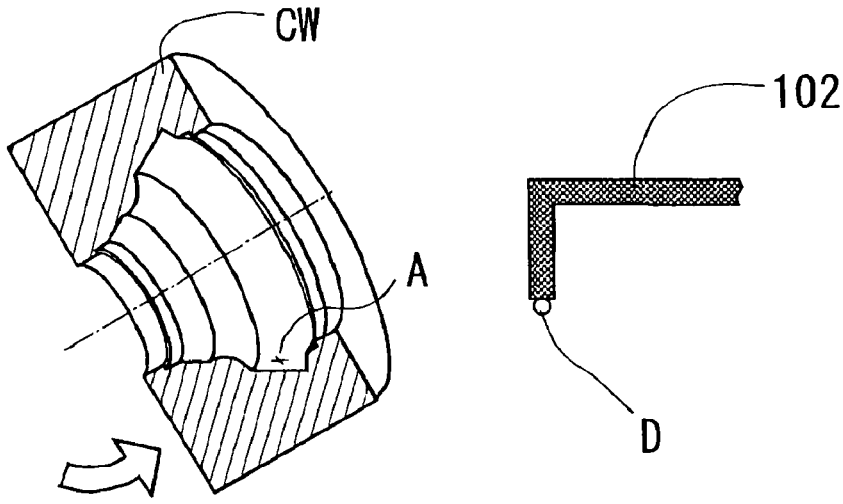
FIG. 22 Prior Art
FIG. 22 is an explanatory view for showing another state in the setting operation using the right-angle suction nozzle in the prior art setting apparatus.
Figure 23:
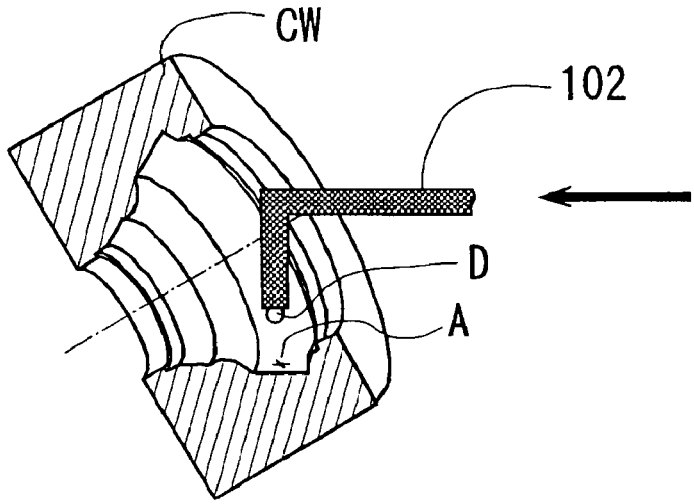
FIG. 23 Prior Art
FIG. 23 is an explanatory view for showing still another state in the setting operation using the right-angle suction nozzle in the prior art setting apparatus.
Figure 24:
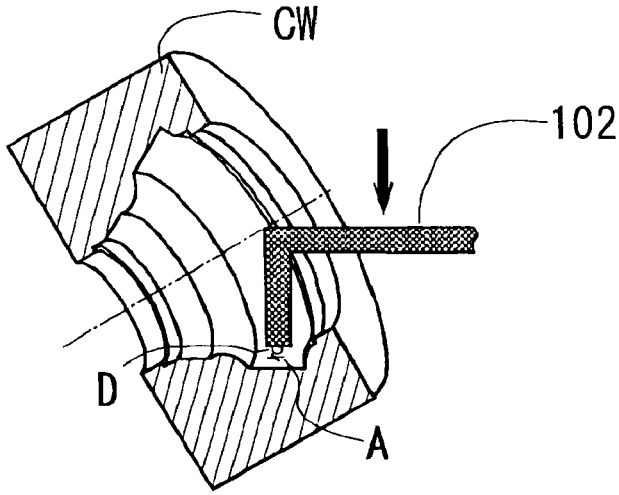
FIG. 24 Prior Art
FIG. 24 is an explanatory view for showing a further state in the setting operation using the right-angle suction nozzle in the prior art setting apparatus.
Figure 25:
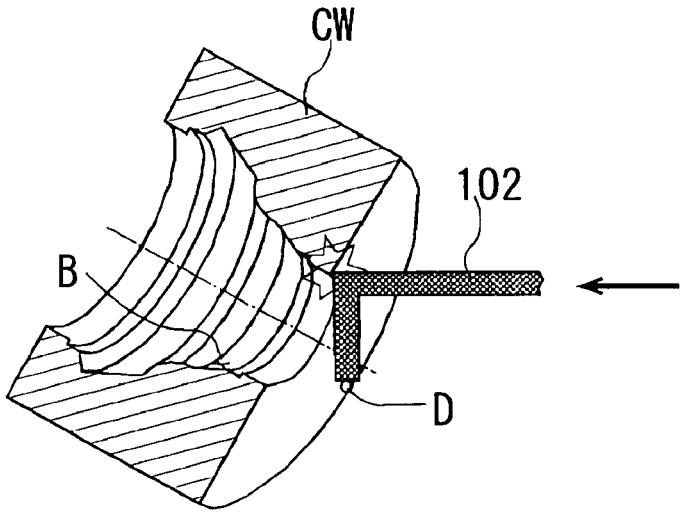
FIG. 25 Prior Art
FIG. 25 is an explanatory view for showing a state in a setting operation from the side of a small-diameter opening using the right-angle suction nozzle in the prior art setting apparatus.

Further, as shown in FIG. 18, it may be the case that a grain D of diamond abrasive should be set at point B on a slant mounting surface of the manufacturing mold CW whose hole has an opening small in diameter. In this case, as shown in FIG. 19, the right-angle suction nozzle 74 is brought into the manufacturing mold CW held upstanding from the front side thereof by being moved in parallel to the axis of the manufacturing mold CW. Then, the right-angle suction nozzle 74 is turned to make the axis of the nose portion 74*n* normal to the slant mounting surface at point B and then, is moved to press the grain D of diamond abrasive held thereon on the slant mounting surface. By repeating the aforementioned setting operation in this way, the setting work can be done even in the case that such setting work is impossible for the prior art setting robot system, and therefore, the automatization in the abrasive grain setting work can be further enhanced.

Further, it may be the case that mounting the diamond abrasive grains D from one side of the manufacturing mold CW is difficult in dependence on the shape of a mounting surface of the manufacturing mold CW. In this case, the horizontal turning mechanism 44 of the grip and raising device 6 is operated to horizontally turn the manufacturing mold CW through the angle of 180 degrees, so that the setting work can be done from the other or opposite side of the manufacturing mold CW.

Figure 8:
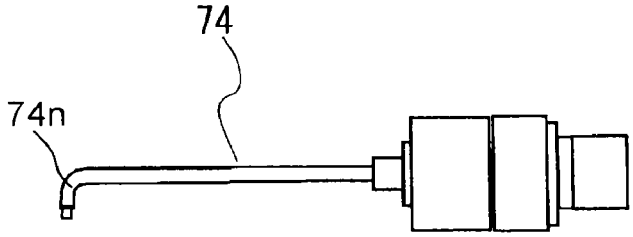
FIG. 8 is a side view of a right-angle suction nozzle used in the superabrasive grain setting apparatus.
Figure 9:
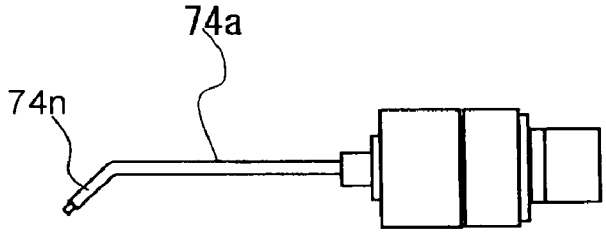
FIG. 9 is a side view of a short-nose gentle-angle suction nozzle used in the superabrasive grain setting apparatus.
Figure 10:
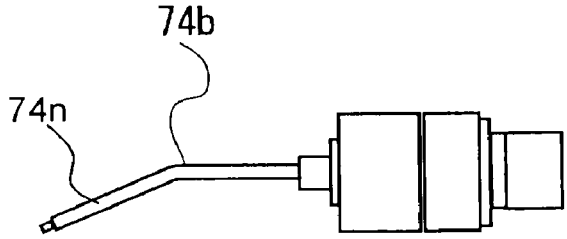
FIG. 10 is a side view of a long-nose gentle-angle suction nozzle used in the superabrasive grain setting apparatus.

Further, the long-nose gentle-angle nozzle 74*b* whose nose portion 74*n* is bent an angle of about 30 degrees as shown in FIG. 10 may be selectively used, which is different in bent angle and nose length from the right-angle nozzle 74 typically shown in FIG. 8 and from the short-nose gentle-angle nozzle 74*a* whose nose portion is bent an angle of about 45 degrees as shown in FIG. 9. In this case, an interference which may occur by the use of any of the right-angle suction nozzle 74 and the short-nose gentle-angle suction nozzle 74*a* because any other portion than the extreme end of any such suction nozzle comes into contact with a projecting part of the manufacturing mold CW can be prevented by the use of the long-nose gentle-angle nozzle 74*b*, as demonstrated in FIG. 17. That is, where the long-nose gentle-angle nozzle 74*b* is used, it becomes possible to perform setting the grain D of diamond abrasive on a mounting surface which is inclined to face a small-diameter opening on the other side of the manufacturing mold CW, by inserting the long-nose gentle-angle suction nozzle 74*b* into the manufacturing mold CW from the side of the small-diameter opening and then, by setting the axis of the nose portion 74*n* of the suction nozzle 74*b* to be normal to the mounting surface without any interference with other parts of the manufacturing mold CW. This setting operation effectively takes the advantages of the long-nose gentle-angle nozzle 74*b*. This advantageously makes it possible to perform accurate setting works on various mounting surfaces at the internal surface of the manufacturing mold CW.

The manufacturing mold CW on which the setting work of the diamond abrasive grains D has been completed is brought down by the grip and raising mechanism 6 to the horizontal state and is placed on the loading and fixing portion 20 at the grip position of the loading table device 4. Then, the grip and raising mechanism 6 releases the manufacturing mold CW and turns up to the upright position to become ready for mold exchange. Since another or new manufacturing mold CW has already been gripped by the sliding rods 16 at the other loading and fixing portion 20, the subsequent half-turn of the upper table 12 exchanges the mutual positions of the manufacturing mold CW which has been set with diamond abrasive grains D and the new manufacturing mold CW. The manufacturing mold CW on which the setting work has been completed is picked up from the loading table device 4 and is transferred to the next manufacturing process, while the new manufacturing mold CW is gripped by the grip and raising mechanism 6 after the same is brought down, and is raised to the upright position, so that the setting work of diamond abrasive grains D is performed by the six-axis control robot 10 in the same manner as described above. Needless to say, the unloading operation for the manufacturing mold CW which has been set with diamond abrasive grains D and the loading operation of the new manufacturing mold CW can be controlled mainly under the control of the actuator control PLC 374.

According to the foregoing superabrasive grain setting apparatus 2 typically shown in FIGS. 1 and 2, the diamond abrasive grains D supplied by the superabrasive grain supply device 8 are drawn, transferred and mounted one by one by the six-axis control robot 10 on each of the programmed target positions on the mounting surface of the manufacturing mold CW which is gripped and raised by the grip and raising mechanism 6. Therefore, the automatization of the setting work for the manufacturing mold CW can be enhanced without need of human hand works.

Further, as shown in FIGS. 12-14, in setting each grain D of superabrasive, the suction nozzle 74 (74*a*, 74*b*) is first positioned to the reference position BP which is before the manufacturing mold CW, in parallel relation with the axis of the manufacturing mold CW and then, is moved in a direction along an oblique side on the aforementioned imaginary cone which spreads from the reference position BP toward those positions adjacent to the mounting target positions on the manufacturing mold CW. Therefore, each of the settings can be done through a simplified control operation involving an linear movement in an oblique direction.

Further, where the manufacturing mold CW takes a cylindrical shape having a hole whose opening on one side is small in diameter, the setting of each grain D of superabrasive on a mounting surface can be done through another simplified control operation wherein as shown in FIGS. 18 and 19 for example, the suction nozzle 74 (74*a*, 74*b*) is entered the hole through a movement in a direction parallel to the axis of the manufacturing mold CW and then, is moved along the axis of the nose portion 74*n* thereof, without bringing any portion of the suction nozzle 74 (74*a*, 74*b*) into contact with any projecting part of the manufacturing mold CW.

Further, as shown in FIG. 1, since the nozzle magazine 88 is provided for storing the plurality of suction nozzles 74, 74*a*, 74*b* the nose bent angles of which are different from one another, it becomes possible to selectively use the suction nozzle having the nose bent angle which is suitable to the mounting surface of the manufacturing mold CW and which is easier to stride over a projecting part of the manufacturing mold CW. Thus, it becomes possible to direct the axis of the bent nose portion 74*n* of the selected suction nozzle in a direction normal to the mounting surface, so that the automatisation in the setting work can be further enhanced.

Further, since the diamond abrasive grains D assorted into plural kinds are provided for selective use, it becomes possible to selectively mount different abrasive grains on different mounting surfaces of the manufacturing mold CW. Moreover, it becomes possible to successively perform setting works on a plurality of manufacturing molds CW which are different in kind or type. Therefore, the efficiency in manufacturing grinding tools can be enhanced remarkably because the manufacturing of a manufacturing mold CW takes a substantial part of the process for manufacturing each grinding tool.

Further, even where certain steps of the mounting work are difficult to do from one side of the manufacturing mold CW, they can be easily done by turning the manufacturing mold CW to replace one and the other sides of the same with each other. Thus, it becomes possible to do all steps of the setting work automatically without human intervention, so that the efficiency in manufacturing grinding tools can be enhanced remarkably.

Further, since the programmed target positions on the manufacturing mold CW to which diamond abrasive grains D are to be mounted are calibrated by detecting the actual position of the manufacturing mold CW prior to the mounting work, it becomes possible to mount the diamond abrasive grains D precisely at the programmed target positions on the manufacturing mold CW.

Figure 17:
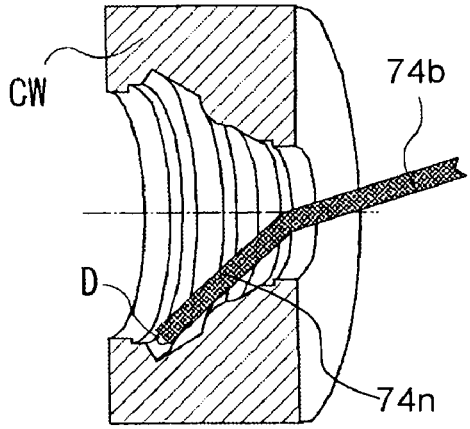
FIG. 17 is an explanatory view for showing a state in a setting operation from the side of a small-diameter opening using the long-nose gentle-angle suction nozzle.

Furthermore, as shown in FIG. 17 for example, the hole of the manufacturing mold CW may have a large opening and a small opening at opposite ends thereof and a slant mounting surface which is provided closer to the large opening than the small opening to be inclined to face the small opening. In this case, the long-nose gentle-angle suction nozzle 74*b* whose nose portion 74*n* is longer than those of other suction nozzles 74, 74*a* and is bent by a gentle angle (e.g., about 30 degrees) is selected and attached to the endmost arm 84 of the six-axis control robot 10, so that it becomes easier to mount superabrasive grains D on the slant mounting surface close to the large opening from the side of the small opening.

Although in the foregoing embodiment, diamond abrasive grains are used as the superabrasive grains D, there may be used CBN (Cubic Boron Nitride) abrasive grains.

Further, although in the foregoing embodiment, the manufacturing mold CW is a female-type mold taking a generally cylindrical form wherein the setting work of superabrasive grains is performed on the internal surface of the female-type mold, there may be used a male-type mold in place of such a female-type mold, in which case the setting work of superabrasive grains may be performed on the outer circumferential surface of the male-type mold. In setting superabrasive grains on an external surface of a male-type mold, each grain D on the suction nozzle 74 attached to the six-axis control robot 10 can also be linearly moved in an oblique direction along an oblique side on an imaginary cone from a mounting start position BP (refer to FIG. 12). This can be done by obtaining by calculation an imaginary cone which is acute in the vertex angle and which is long in the axis thereof, that is, by employing an elongated imaginary cone.

Obviously, further modifications and variations of the present invention are possible in light of the above teachings. It is therefore to be understood that within the scope of the appended claims, the present invention may be practiced otherwise than as specifically described herein.

What is claimed is:

1. A superabrasive grain setting apparatus for arranging superabrasive grains, used to form a grinding surface of a grinding tool, on a surface of a manufacturing mold which is used in manufacturing the grinding tool, the apparatus comprising:

a grip and raising mechanism for gripping the manufacturing mold placed in a horizontal state and for turning the manufacturing mold to an upright position so as to make the axis of the manufacturing mold extend horizontally;

a six-axis control robot composed of a base arm mechanism with three controlled axes and a wrist unit with three controlled axes attached to the base arm mechanism, wherein the three controlled axes of the wrist unit comprise a sixth axis for turning an endmost arm about its own axis, a fifth axis intersecting with the sixth axis for pivoting the endmost arm and the sixth axis about its own axis, and a fourth axis for turning the endmost arm, the sixth axis and the fifth axis about its own axis intersecting with the fifth axis, and wherein the three controlled axes of the base arm mechanism comprise a third axis intersecting with the forth axis to extend horizontally, a second axis extending in parallel with the third axis, and a first axis including a swivel member pivotably supporting the second axis for turning the swivel member about its own axis extending vertically;

a superabrasive grain supply device provided with a grain storage for storing the superabrasive grains and a grain separation mechanism for separating the superabrasive grains stored in the grain storage one by one to a suction position; and a suction nozzle detachably mounted on the endmost arm of the six-axis control robot and provided with a nose portion bent to have a nozzle end which is eccentric from the fifth and sixth axes, for drawing a grain of superabrasive to the nozzle end at the suction position.

2. The superabrasive grain setting apparatus as set forth in claim 1, further comprising:

a nozzle magazine for storing a plurality of suction nozzles including the aforementioned suction nozzle the nozzle angles of which are different from one another, the plurality of suction nozzles being selectively attachable to the endmost arm of the six-axis control robot.

3. The superabrasive grain setting apparatus as set forth in claim 1, wherein the superabrasive grain supply device comprises a plurality of grain storages for storing the superabrasive grains therein on a kind-by-kind basis.

4. The superabrasive grain setting apparatus as set forth in claim 1, wherein the grip and raising mechanism includes a turn mechanism for turning the manufacturing mold at the upright position about a vertical axis through a half rotation.

5. The superabrasive grain setting apparatus as set forth in claim 1, wherein the manufacturing mold takes a generally cylindrical form having a hole at a radial center portion thereof and flat end surfaces at axial opposite ends thereof, the apparatus further comprising:

a touch sensor for detecting the contact of the nozzle end of the suction nozzle with one of the flat end surfaces of the manufacturing mold facing the six-axis control robot;

reference surface calculation means for calculating three-dimensional coordinates of a mounting reference surface for the manufacturing mold based on a plurality of contact points which are determined by the touch sensor when the suction nozzle is brought into contact with plural places on one of the flat end surfaces of the manufacturing mold facing the six-axis control robot;

hole center calculation means for calculating three-dimensional coordinates of a center of the hole formed in the manufacturing mold from positions which are determined when the suction nozzle on the endmost arm of the six-axis control robot is disengaged from one of the flat end surfaces of the manufacturing mold facing the six-axis control robot on the way of a movement of the suction nozzle from each of the contact points toward the center of the hole; and robot control means for controlling the six-axis control robot in accordance with an abrasive grain mounting program after calibrating the coordinates of the robot based on the three-dimensional coordinates of the reference surface and the center of the hole which are calculated by the reference surface calculation means and the hole center calculation means.

6. The superabrasive grain setting apparatus as set forth in claim 5, wherein in mounting the grain of superabrasive held by the suction nozzle on one of target mounting positions to which the superabrasive grains are to be mounted, the robot control means controls the six-axis control robot so that the grain of superabrasive on the suction nozzle attached to the six-axis control robot is moved along an oblique side on an imaginary cone whose base circle is along the plurality of target mounting positions.

7. The superabrasive grain setting apparatus as set forth in claim 6, wherein the robot control means is capable of obtaining by calculation the imaginary cone based on the abrasive grain mounting program and the three-dimensional coordinates of the reference surface and the center of the hole which are calculated by the reference surface calculation means and the hole center calculation means.

8. The superabrasive grain setting apparatus as set forth in claim 2, wherein:

the hole of the manufacturing mold has a large opening and a small opening at opposite ends thereof and a slant mounting surface which is provided closer to the large opening than the small opening to be inclined to face the small opening; and the plurality of suction nozzles includes a long-nose gentle-angle suction nozzle whose nose portion is longer than those of other suction nozzles and is bent by a gentle angle which is smaller than an angle of 45 degrees, the long-nose gentle-angle suction nozzle being attached to the endmost arm of the six-axis control robot in mounting a grain of superabrasive on the slant mounting surface.

* * * * *